United States Patent [19]

Alexander

[11] Patent Number: 4,928,466

[45] Date of Patent: May 29, 1990

[54] RETAINING AND ANCHORING HARDWARE FOR A CERAMIC FIBER MODULE

[76] Inventor: Michael E. Alexander, 3616 Ashbury, Ponca City, Okla. 74601

[21] Appl. No.: 361,318

[22] Filed: Jun. 5, 1989

[51] Int. Cl.[5] ..... E04B 1/38

[52] U.S. Cl. ..... 52/509; 110/336

[58] Field of Search ..... 52/509, 506, 404, 587, 52/726; 110/336, 338, 339

[56] References Cited

U.S. PATENT DOCUMENTS

| | | | |
|---|---|---|---|
| 4,088,825 | 5/1978 | Carr | 110/336 |
| 4,103,469 | 8/1978 | Byrd | 52/509 |
| 4,391,075 | 7/1983 | Musgrave | 52/404 |
| 4,516,374 | 5/1985 | Finney | 110/336 |
| 4,571,911 | 2/1986 | Dunlap et al. . | |

*Primary Examiner*—John E. Murtagh

[57] ABSTRACT

An insulation assembly consisting of a blanket of insulation folded into a plurality of "S" folds to form an insulation bundle having length, width and depth with a rod having first and second end portions and passing longitudinally through the insulation bundle along its length. The rod has an axial opening at one end and the remaining end portion has a narrowed diameter which is less than the diameter of the axial opening. A bracket is attached to the rod and extends below the insulation bundle so that it can be attached to a surface.

With the above construction, a series of bundles can be secured to the surface by securing the first bundle to the surface, then attaching additional bundles by inserting the narrowed end of the rod into the axial opening of the preceding bundle and then attaching the bracket for each bundle to the surface to be insulated.

6 Claims, 1 Drawing Sheet

RETAINING AND ANCHORING HARDWARE FOR A CERAMIC FIBER MODULE

RELATED APPLICATIONS

This Application is related to an Application entitled "Insulation Retaining Apparatus", Ser. No. 361,360, filed June 5, 1989, by the same inventor as this Application and filed concurrent with this Application.

BRIEF DESCRIPTION OF THE PRIOR ART

The best prior art known to Applicant is U.S. Pat. No. 4,571,911. This patent basically comprises an insulating supporting apparatus which comprises an "L" shaped bracket with means for attaching a base portion of the bracket to the surface of a furnace, for example. The end extending from the surface has a slot which is angled to the longitudinal axis of the bracket. A tine extends longitudinally through the slot and extends on each side of the bracket, the tine being substantially parallel to the surface of the furnace. On each end of the tine are points for inserting the insulation material onto the tine and the tine further includes indentations to prevent the tine from sliding further than a predetermined distance into the aforementioned slot.

The modular insulation anchor previously described has a substantial problem when vibration is present on or along the surface of the furnace. The sharp edges of the tine tend to cut into and cause destruction of the blankets of insulation folded over the tine. Over a period of time, the insulation can become dislodged and fall from the supporting anchors, thereby causing the furnace to loose its insulation characteristics, thereby necessitating immediate repair of the furnace.

BRIEF DESCRIPTION OF THE INVENTION

This invention describes an insulation assembly which includes a blanket of insulation folded into a plurality of "S" folds to form an insulation bundle having length, width and depth. A rod has its first end passing longitudinally through the insulation bundle along its length. The rod has an axial opening on one end and a narrowed portion on the remaining end. A bracket is attached to the rod and extends below the insulation bundle and has its end adapted for attachment to the surface to be insulated. The attachment can either be through rivets, bolts or by welding.

The insulation bundles are installed by securing the first end of the first bundle to the sidewall and attaching the brackets to the surface to be insulated. The succeeding bundles are then attached by slipping the narrowed end of the rod into the opening of the proceeding bundle and then attaching the brackets to the surface to be insulated.

A modified form of the insulation assembly is provided by a bracket having a substantial width to accommodate two rods and two bundles or, a wide bundle such as a bundle twice the width of the first described bundle. As an example, a rod is normally designed to support a bundle having width of one foot; while the two rod insulation assembly will support an insulation assembly which is two feet wide. The two foot wide bundles can either be two, one foot bundles attached by two rods or one, two foot bundle attached by two rods.

DETAILED DESCRIPTION OF THE FIGURES

Figure 1:
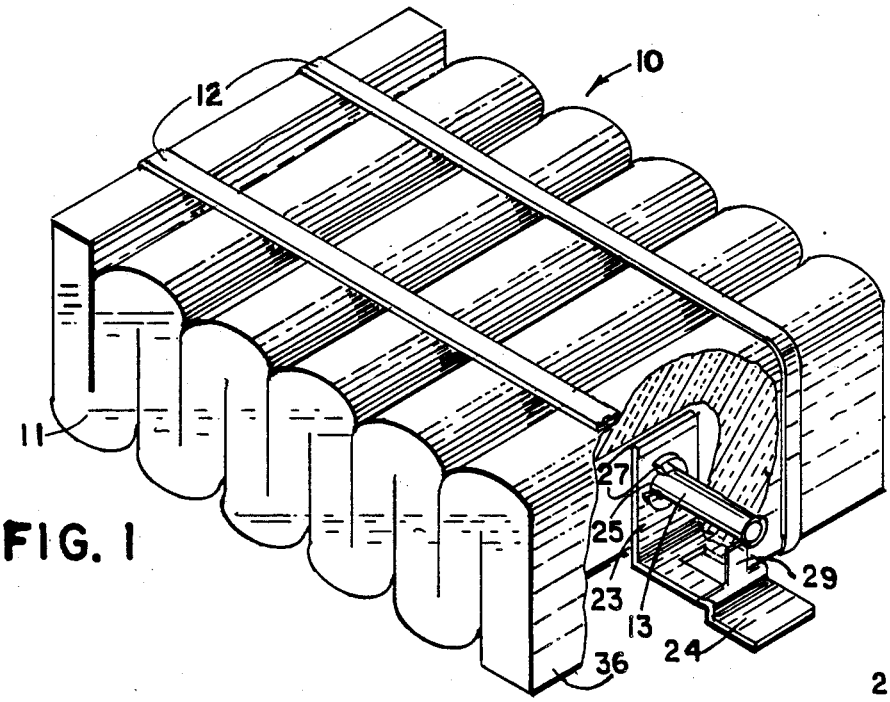
FIG. 1 is a orthogonal projection of a bundle with a portion of the bundle cut away to show the installation of the bracket and clip.
Figure 2:
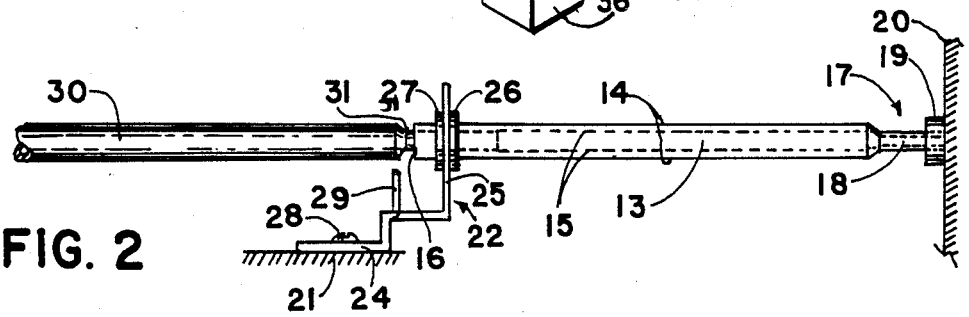
FIG. 2 illustrates a method for installing each of the bundles in order to insulate a surface.

Referring to all of the FIGURES, but in particular to FIG. 1, a bundle referred to generally by arrow 10, comprises a plurality 11 of "S" folds of ceramic fiber insulation. Bundle 10 is retained in its shape by a pair of straps 12. A rod 13 is impaled through insulation bundle 10 along its length. Rod 13, in the preferred embodiment, is made of a tube having an outer diameter 14 and an inner diameter 15. One end 16 has an opening of the same diameter as diameter 15 before described. Remaining end 17 has a reduced diameter 18 which has its outer diameter equal to or smaller than inner diameter 15 of tubular rod 13. End 17 is initially retained by a mounting ring 19 or by welding against a vertical surface 20. Opposite end 16 is retained against a surface 21 to be insulated by a bracket 22 which has a vertical portion 23 and a horizontal portion 24, as shown in FIGS. 1 and 2. It is obvious that the vertical or horizontal orientation is in reference to the FIGURES only. The brackets need not be mounted horizontally or vertically as illustrated, since they are configured to insulate a surface regardless of its orientation.

Vertical portion 23 has an opening 25 for receiving end 16 of rod 13. Clips 26 and 27 are placed on each side of vertical portion 23 to prevent portion 23 from sliding longitudinally along the axis of rod 13. Horizontal portion 24 is adapted to be attached to surface 21 by any usual means such as screws 28 or welding, riveting or any other well known form of attachment. A vertical portion 29 on bracket 22 helps retain an end 36 of insulation bundle 10 in position. It is obvious that vertical portion 29 is a convenience and not necessary for the functioning of this invention.

Referring to FIG. 2, a subsequent rod 30 has its narrowed end 31 inserted into end 16 of rod 13 for support of the next bundle of insulation. A second bracket, not shown, is likewise attached to rod 30 in the manner illustrated for rod 13 and it too will in turn be attached to surface 21 to provide insulation for surface 21.

Figure 3:
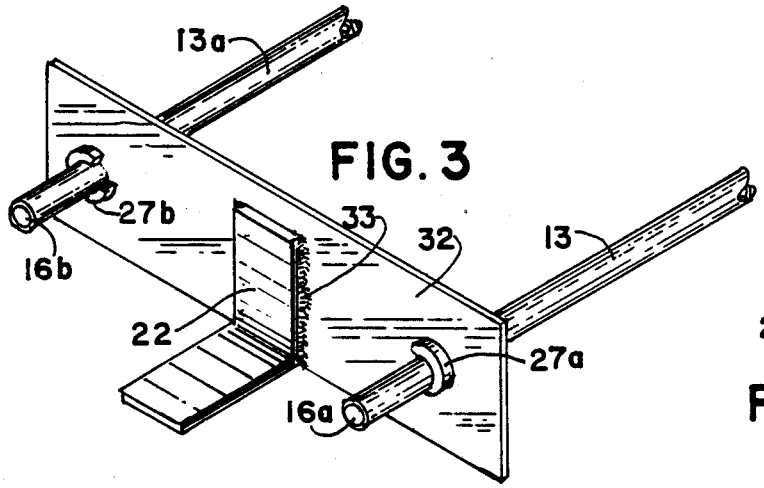
FIG. 3 illustrates an orthogonal projection of an extended supporting bracket supporting two rods for a double width bundle; and, FIG. 4 shows a modified method for attaching the support bracket to the rod.

A modified form of bracket 22 is illustrated in FIG. 3. Here bracket 22 has a extended portion 32 which extends to each side of bracket 22 by an amount sufficient to support a pair of rods 13 and **13*a*. Rods 13 and 13*a* are spaced by an amount sufficient to support bundles normally having a width twice the width of bundle 10. The bundle supported by rods 13 and 13*a* can be a pair of bundles having the same width as bundle 10 or a single bundle having twice the width of bundle 10. Other than bracket extension 32 supporting two bundles, the attachment to extension 32 is identical to that for bracket 22 by the use of clips 27*a* and 27*b* and 26*a* and 26*b* behind bracket extension 32, such clips not being shown in FIG. 3. Bracket 22 can be attached to bracket 32 by forming a single piece or by welding at cite 33 as illustrated in FIG. 3**.

Figure 4:
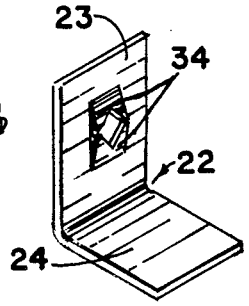

Bracket 22 can be retained along the length of rod 13 in one of several ways without necessarily using "C" clips 26 or 27, for example. Such a modified bracket is illustrated in FIG. 4 where vertical portion 23 is shown to have a pair of spring clips 34, sometimes referred to as "push nuts" which when forced over rod 13, the prongs of nut 34 tend to grip into the metal outer surface of rod 13 preventing bracket 22 from moving toward end 16, for example. The same type of attachment can be also be used in place of clips 27*a* and 27*b* in FIG. 3. Other arrangements are obvious and could be utilized to position bracket 22. Such other arrangements are well within the skill of the art and will not be further disclosed.

CONCLUSIONS

A novel method for attaching an insulation bundle is disclosed. The rod utilized in this bundle attachment has a large diameter and will not cause damage to the bundle by vertical movement of the bundle; such vertical movement being caused by vibration transmitted through surfaces 20 or 21 of the bundle. The bundles can be easily and quickly attached by merely inserting the next bundle into the opening of the rod of the preceding bundle. Whether one rod or two rods are used for a small or large bundle, the assembly is identical. Thus, a novel bundle has been disclosed which provides for rapid installation and extreme security for extended use.

It is obvious, of course, that other modifications can be made and still be well within the spirit and scope of this invention as described in the specifications and appended claims.

What I claim is:

1. An insulation support apparatus for use in attaching blanket insulation to a surface comprising:

(a) an elongated cylindrical tubular member means having an inner diameter, an outer diameter and having a first and second end portions, said first end portion having its outer diameter equal to or less than the inner diameter of said tubular means so that said first end portion can slidably fit into a second end portion of a preceding cylindrical tubular member;

(b) a bracket means having a first and second end, means at said first end for attachment to said surface, an opening means at said second end for receiving said elongated cylindrical tubular member means; and (c) means for retaining said elongated tubular member means at a selected location along its length when received by said opening means.

2. Apparatus as claimed in claim 1 wherein said elongated cylindrical tubular member is retained by placing a pair of "C" clips on each side of said bracket means and around said elongated cylindrical tubular member means.

3. Apparatus as claimed in claim 1 wherein said bracket means is "L" shaped and where said base has a portion bent in a manner to retain said blanket insulation in position.

4. Apparatus as claimed in claim 1 wherein said bracket means includes a cross bracket portion attached to said longitudinal stud member to form a "T" shaped bracket means, and wherein a pair of spaced elongated cylindrical tubular members are attached to said cross bracket portion.

5. An insulation assembly comprising:

(a) a blanket of insulation folded into a plurality of "S" folds to form an insulation bundle having length, width and depth;

(b) rod means having a first and second end portion, said rod means passing longitudinally through said insulation bundle along its length, said rod means having an axial opening into one end portion and having said second portion with a narrowed diameter which is less than the diameter of said axial opening;

(c) bracket means attached to said rod means and extending below said insulation bundle; and, (d) means for attaching said bracket means to a surface;

whereby a series of bundles can be secured to said surface by securing said first bundle to said surface, then inserting said end with said narrowed diameter of said rod means of a next bundle in each proceeding axial opening, then attaching said bracket means of each rod means to said surface.

6. Apparatus as claimed in claim 5 wherein said bracket means includes a cross member attached to said bracket means to form a "T" shaped bracket means, and wherein a pair of spaced rod means are passed through said cross members.

* * * * *